US007608032B2

(12) United States Patent
Robertson et al.

(10) Patent No.: US 7,608,032 B2
(45) Date of Patent: Oct. 27, 2009

(54) PROCESS FOR MANUFACTURING A TAMPER EVIDENT CONTAINER LID

(75) Inventors: Ronald Dean Robertson, Kansas City, MO (US); George Edward Mac Ewen, Kansas City, MO (US)

(73) Assignee: Huhtamaki Consumer Packaging, Inc., DeSoto, KS (US)

( * ) Notice: Subject to any disclaimer, the term of this patent is extended or adjusted under 35 U.S.C. 154(b) by 0 days.

(21) Appl. No.: 12/211,207

(22) Filed: Sep. 16, 2008

(65) Prior Publication Data

US 2009/0011914 A1 Jan. 8, 2009

Related U.S. Application Data

(62) Division of application No. 11/130,878, filed on May 17, 2005.

(51) Int. Cl.
*B31B 3/00* (2006.01)

(52) U.S. Cl. ..... 493/52; 493/59; 493/69; 493/79; 220/276

(58) Field of Classification Search ..... 493/52, 493/59, 63, 69, 79; 215/256; 220/256, 266, 220/270, 276; 229/102, 123.2, 125.13, 152, 229/940

See application file for complete search history.

(56) References Cited

U.S. PATENT DOCUMENTS 3,235,164 A 2/1966 Anderson et al.
4,478,343 A * 10/1984 Ostrowsky ..... 215/252
4,493,432 A 1/1985 Smith
5,002,198 A 3/1991 Smith
5,253,772 A * 10/1993 Earnest ..... 220/276
5,658,228 A * 8/1997 Van de Geijn et al. ..... 493/109
6,257,485 B1 7/2001 Sadlier et al.
6,772,901 B2 8/2004 Witt
2003/0136784 A1 7/2003 Smith
2004/0074861 A1 4/2004 Chuang et al.
2008/0099481 A1* 5/2008 D'Amato ..... 220/276

* cited by examiner

*Primary Examiner*—Thanh K Truong
(74) *Attorney, Agent, or Firm*—Husch Blackwell Sanders LLP

(57) ABSTRACT

A tamper evident and resistant container lid of the present invention includes a lid body configured to cover the opening of a base container having a top rim and a skirt extending from the lid. The skirt has an annular score line and an annular fold line extending therearound. An outer band of the skirt extends between the score line and the fold line, and an inner band folded inwardly to be in opposing relation to the outer band extends upwardly from the fold line to an upper free edge. When the container lid is sufficiently applied to the base container such that the second portion slides downwardly past a top rim of the base container, achieving a proper closure, an attempt to remove the lid will cause a plurality of sections of the inner band to engage the top rim and impede removal of the container lid from the base container.

5 Claims, 2 Drawing Sheets

PROCESS FOR MANUFACTURING A TAMPER EVIDENT CONTAINER LID

CROSS-REFERENCE TO RELATED APPLICATIONS

This application is a Divisional of and claims priority to U.S. application Ser. No. 11/130,878 filed May 17, 2005, currently pending, entitled "Tamper Evident Container Lid," the entire disclosure of which is incorporated herein by reference to the extent permitted by applicable law.

BACKGROUND OF THE INVENTION

There has been increasing interest in food safety on the part of consumers in recent years due to incidents of nefarious individuals tampering with prepackaged food items. Some prepackaged items have a plastic shrink-wrap type seal around a lid of a container that must be broken in order to access the contents of the container. In the case of plastic soft drink bottles and the like having a round screw-type cap, a lower ring may be attached to a skirt of the cap with a score line. Upon twisting of the cap to remove it from the bottle, the screw threads of the bottle impede the upward movement of the lower ring, thereby breaking the ring from the skirt of the cap along the score line and allowing the consumer to fully remove the cap to access the bottle contents. A consumer purchasing such a product at a retail store should notice if the ring were separated from the remainder of the cap, indicating someone has had access to the bottle contents and may have tampered with the product.

Various designs have also been proposed for tamper resistant or tamper evident lids for round food containers, such as ice cream containers and the like. Such tamper resistant/evident lids are designed to provide a visual indication to the purchaser as to whether the lid has been peeled back or otherwise removed from the base food container to expose the contents. One particular configuration is provided in U.S. Pat. No. 5,653,382, issued to Van De Gejin et al, which shows a container lid formed with a skirt having a sufficient downward length so that the same can be curled upward to form a return bend having a radius and an upwardly directed free end. The free end of the curled skirt serves to impede the removal of the container lid once applied by abutting with a lower edge of a rim of the base container. This design has a serious drawback, however, in that the upwardly curled portion of the skirt extending to the free end tends to become uncurled at the curved return bend when the container lid is pulled upward forcefully impacting the free end with the rim. Thus, the lid could easily be removed and reapplied to a food container with the return bend re-curled to give the appearance that the lid hadn't been removed and no tampering had taken place. Other tamper resistant/evident designs are available that incorporate lid skirts with abutting members, but unfortunately, many of these position the abutting members where they may be slid past any catching portion (e.g., the rim) of a base container. As a result, any tamper resistant or tamper evident feature of such a lid may be defeated.

BRIEF SUMMARY OF THE INVENTION

A tamper evident and resistant container lid provides an improved solution for securely covering a base container. The container lid is configured to be difficult to remove from the base container without causing noticeable modification or damage to the container lid. As such, the container lid improves the confidence of consumers in the safety of food items purchased in such containers.

In one aspect of the invention, a tamper evident and resistant container lid has a lid body sized to cover the opening of the base container and a convolute-wrapped skirt extending therefrom. Both an annular score line and an annular fold line extend around the skirt. A first portion of the skirt extends downwardly from the lid body to the fold line and a second portion of the skirt extends upwardly from the fold line in generally opposing relation to and inwardly of the first portion. When the container lid is sufficiently applied to the base container such that the second portion slides downwardly past a top rim of the base container, achieving a proper closure, an attempt to remove the lid will cause a plurality of sections of the inner band to engage the top rim and impede removal of the container lid from the base container.

The invention of another aspect includes a tamper evident and resistant container lid having a lid body sized to cover the opening of the base container, and a skirt including an upper section, an outer band and an inner band. The upper section of the skirt extends downwardly from the lid body to an annular score line below which is formed the outer band. The outer band extends between the annular score line and a lower annular fold line. Extending upwardly from the annular fold line is the inner band positioned in generally opposing relation to and inwardly of the outer band. When the container lid is sufficiently applied to the base container such that the inner band slides downwardly past a top rim of the base container, achieving a proper closure, an attempt to remove the lid will cause a plurality of sections of the inner band to engage the top rim and impede removal of the container lid from the base container.

A process for manufacturing the tamper evident and resistant container lid is presented in another aspect of the invention. A sheet is formed of paper stock having leading and trailing edges, top and bottom edges, and longitudinal score and fold lines extending generally from the leading edge to the trailing edge and spaced from one another. The leading edge of the sheet is wrapped over the trailing edge thereof to form an interior overlap region of the sheet proximal to the trailing edge and an exterior overlap region of the sheet proximal to the leading edge. As a next step, the exterior overlap region is sealed to the interior overlap region to form the sheet into a generally cylindrical skirt. A lid body may then be attached with the skirt to form a container lid, and a portion of the skirt below the longitudinal fold line folded inwardly and upwardly towards the lid body to form the skirt portion into an inner band positioned in generally opposing relation to an outer band defined between the longitudinal score line and the longitudinal fold line. The steps of the process are conducted such that a plurality of sections of the inner band are formed to, upon application of the container lid to the base container whereby the inner band is slid downwardly past the base container top rim, impede removal of the container lid from the base container by engaging with the top rim.

BRIEF DESCRIPTION OF THE SEVERAL VIEWS OF THE DRAWING

In the accompanying drawings which form a part of the specification and are to be read in conjunction therewith and in which like reference numerals are used to indicated like elements in the various views.

DETAILED DESCRIPTION OF THE INVENTION

Figure 1:
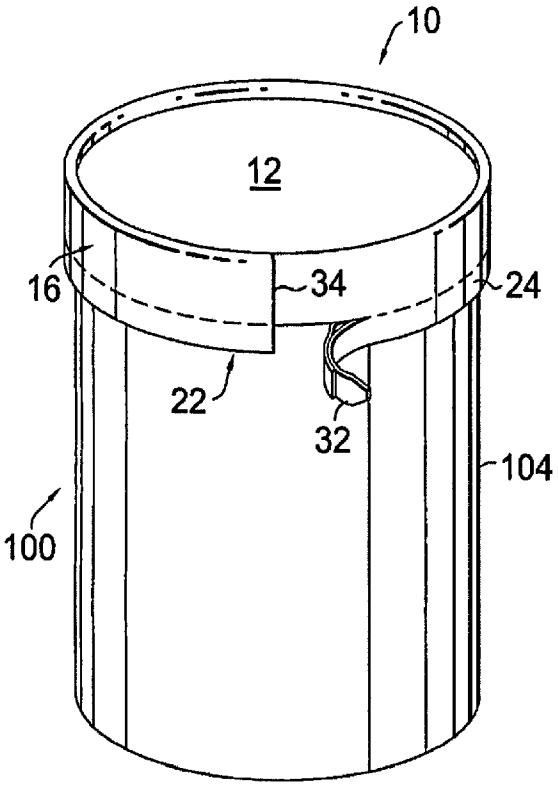
FIG. 1 is a perspective view of one embodiment of a tamper evident container lid of the present invention applied on a base container.

Turning now to the drawings, and initially to FIG. 1, a tamper evident and resistant container cover or lid 10 is shown applied onto an exemplary base container 100 that may house food items. Although shown as being cylindrical and having a circular cross-section, the base container 100 may also be elliptical or another shape in cross-section employing a generally curved profile. The container lid 10 includes a lid body 12 having a perimeter region 14 and an annular downwardly extending skirt 16 circumscribing the perimeter region 14. The skirt 16 may have the same shape as the base container (e.g., cylindrical, elliptical, etc.). Preferably, the skirt 16 is die cut from a sheet of paper stock and may have registered printing applied thereon, and thereafter overlaid with varnish or other protective coating. The lid body 12 may be of similar construction (e.g., of paper stock) and may include registered printing and a protective coating if desired.

The lid body 12 may have a generally disc-like shape inwardly of the perimeter region 14 towards the center thereof, through other shapes may be utilized for the lid body 12. The skirt 16 includes an interconnect portion 18 for coupling the skirt 16 with the lid body 12, a support portion 20 extending downwardly from the interconnect portion 18 and a tamper evident portion 22 separated from the support portion 20 by a perforated annular score line 24. Forming the tamper evident portion 22 is an outer band 26 and an inner band 28 divided along an annular fold line 30, which may be scored in the same fashion as the score line 24. A pull tab 32 extends from the outer band 26 at a leading edge 34 of the skirt 16. When a consumer desires to access the contents held in the base container 100, the tab 32 is pulled away from the remainder of the skirt 16, as seen in FIG. 1, resulting in the tamper evident portion 22 breaking from the support portion 20 at the score line 24. Continual pulling of the tab 32 all the way around the skirt 16 will completely break off the tamper evident portion 22, leaving the interconnect portion 18 and support portion 20 of the skirt 16 behind to, with the lid body 12, serve as a reusable lid for the base container 100. The perforation marks remaining on the support portion 20 of the skirt 16 after removal of the tamper evident portion 22 serve as a visual indication to a purchaser of the product that someone may have had access to the contents of the base container 100.

Figure 2:
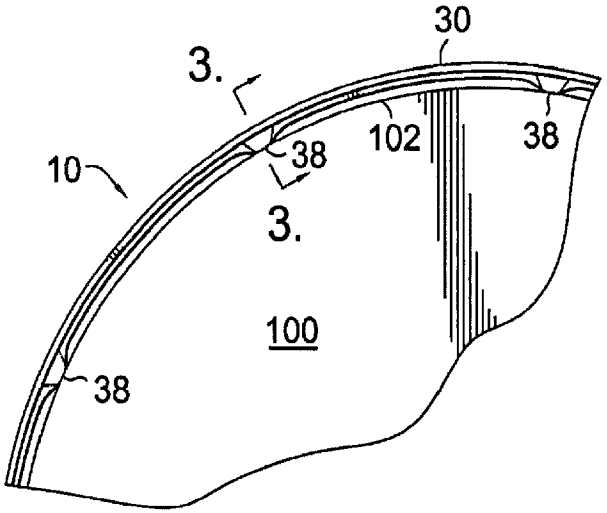
FIG. 2 is a fragmentary bottom plan view of the tamper evident container lid and base container of FIG. 1.
Figure 3:
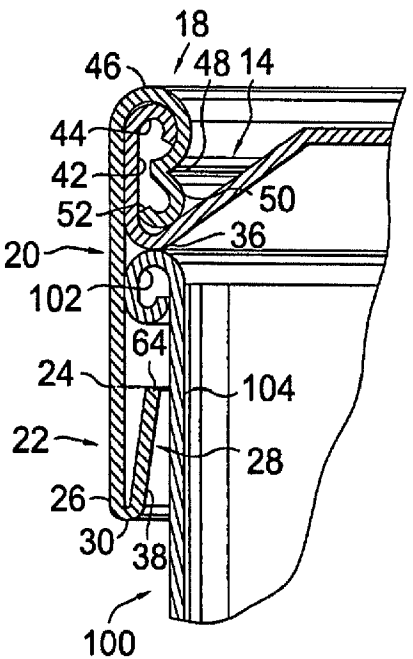
FIG. 3 is a fragmentary cross-sectional view of the tamper evident container lid and base container taken along line 3-3.
Figure 4:
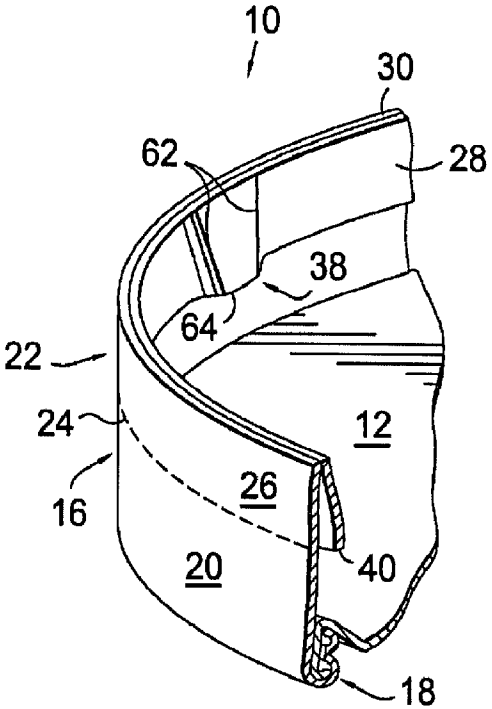
FIG. 4 is a fragmentary bottom perspective view, taken partially in section, of the tamper evident container lid of FIG. 1.

FIGS. 2-4 show more details of the construction of the container lid 10, with the lid 10 applied on the base container 100 in FIGS. 2 and 3, and with the lid 10 separately in FIG. 4. The perimeter region 14 of the lid body 12 includes a lower edge 36 that extends with a curved profile generally matching the profile of a top rim 102 of the base container 100. This arrangement facilitates the lid 10 essentially mating with the top rim 102 and positioning the skirt 16 to envelop the top rim 102 in an annular fashion to provide a good seal between the lid 10 and the base container 100.

The design of the inner band 28 of the skirt 16 enables a tamper resistant feature of the lid 10 to be realized. More specifically, a plurality of sections of the inner band 28 are formed into interference members 38, as best seen in FIGS. 3 and 4. These interference members 38 extend inwardly towards the center of the container lid 10 to generate an interference with a top rim 102 of the base container 100 when the lid 10 is fully applied thereon. Upon pulling of the lid 10 upwardly to remove it from the base container 100, the interference members 38 abut the top rim 102 and prevent lid 10 removal. Because the inner band 28—and thus the interference members 38—has a length defined between the fold line 30 and an upper free edge 40 of the inner band 28 that is greater than the lateral (i.e., radial) gap between the outer band 26 of the skirt 16 and a sidewall 104 of the base container 100, the inner band 28 cannot simply be folded down at the fold line 30 to allow the skirt 16 to slip past the interference with the top rim 102. Additionally, the fold line 30 is formed with a sharp angle between the outer and inner bands 26, 28, and not a large radius curve. This design makes it very difficult to peel back the inner band 28 and facilitates maintaining the integrity of the fold line 30 (and thus the inner band 28) even when relatively large forces are applied to impact the interference members 38 with the top rim 102 when attempting to pull the lid 10 off of the base container 100. Also, the spaced intervals for the interference members 38 may be, for example, an even number (e.g., every 90 degrees around the inner band 28) or may be varied, but should occur frequently enough around the inner right to hamper efforts to pry off the container lid 10 without tearing off the outer and inner bands 26, 28 at the annular score line 24, or otherwise visibly damaging the same.

The interconnection between the lid body 12 and the skirt 16 is achieved by forming the perimeter region 14 with a vertically-extending leg member 42 extending from the lower edge 36 thereof, and shaping the interconnection portion 18 to mate with the leg member 42. More specifically, the leg member 42 has a generally upside down "J" profile with a return bend 44 cradled by an upper lip 46 of the interconnect portion 18. An annular groove 48 is also formed into the interconnect portion 18 below the upper lip 46, and a curved arm 50 extends below the annular groove back towards the lower edge 36 to terminate in a free edge 52. This configuration for the interconnect portion 18 and the leg member 42 provides good interlocking between the lid body 12 and the skirt 16.

Figure 5:
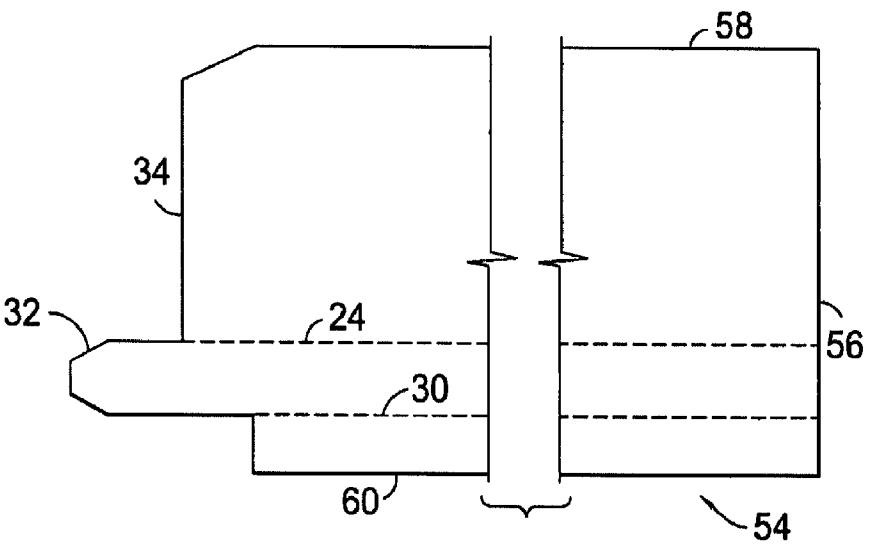
FIG. 5 is side elevational view of a template for the skirt portion of the tamper evident container lid of FIG. 1.

One method of forming the container lid 10 will now be described. The skirt 16 may be die cut from paper stock to achieve the shape necessary for the final design. FIG. 5 shows a die cut skirt template 54 having the leading edge 34, a trailing edge 56, a top edge 58 and a bottom edge 60, with the pull tab 32 extending from the leading edge 34. The score line 24 and the fold line 30, which may be scored as well, are preferably formed on the template 54 to be generally parallel with and spaced from one another and each extend from a point at least close to the leading edge 34 to another point at least close to the trailing edge 56. Also, the score line 24 and fold line 30 may be aligned with the paper grain direction of the template 54 as determined by the paper stock used, which aids in the tamper evident portion 22 of the skirt 16 breaking or tearing away from the support portion 20 at the score line 24. By providing alignment with the paper grain direction in this fashion, the present invention avoids the use of traditional spiral wound techniques often employed in the manufacture of traditional container lid configurations. If spiral wound techniques were used, an erratic tearing action would result when pulling on the tab 32 due to interruption of a ply gap of the skirt material at the score line 24. More specifically, a diagonal gap would span through the skirt 16, creating in weak points in the skirt material approaching, and moving away from, the score line 24. Thus, pulling on the tab to break away the tamper evident portion 22, with a spiral would skirt 16, would often results in tearing of the skirt 16 away from the score line 24 upward into the support portion 20 or downward into the outer band 26, which is clearly undesirable. Another advantage provided by convolute wrapping is that printed instructions can be applied to the skirt 16 at the pull tab 32 location. Printing in this fashion is quite difficult if spiral wound techniques were employed because random location printing is typically required.

Next, the template 54 is convolute wrapped, or bent in a curve fashioned to form a complete loop with the leading edge 34 overlapping the trailing edge 56. The amount of overlap between the leading and trailing edges 34, 56 is chosen to achieve the initial outline of the skirt 16 with the correct dimensions to fit over the base container 100 and such that adequate surface area is presented for applying adhesive to secure or seal the region of the skirt 16 near the leading edge 34 to the region of the skirt 16 near the trailing edge 56. Various adhesives, such as industry recognized food grade adhesives, may be used in forming the skirt as described.

The lid body 12 may also be die cut as previously described to have a shape that will fit within the formed skirt 16. The leg member 42 of the lid body 12 may be shaped as shown in FIG. 3 by crimping the lid body 12 having a disc-like shape to form the curved lower edge 36 and the leg member 42, and also crimping the leg member 42 near the terminus thereof to form the return bend 44. Similarly, the shape of the interconnect portion 18 of the skirt 16 may be attained by crimping the template 54 in the form of the skirt 16 above the score line 24 to form the curved upper lip 46, and again crimping portions of the skirt 16 between the upper lip 46 and the template top edge 58 to form the annular groove 48 and curved arm 50. One technique that may be employed is to crimp the skirt interconnect portion 18 over the leg member 42 after the leg members 42 has been finally formed, resulting in interlocking of the lid body 12 with the skirt 16. However, those of skill in the art will appreciate that other sequences may be employed to cause interlocking between the lid body 12 and the skirt 16.

At this point, the portion of the skirt 16 below the fold line 30 may be folded inwardly and upwardly along the fold line 30 towards the lid body 12 to form the inner band 28. The inner band 28 is thereby positioned in opposing relation to the outer band 30 formed between the score line 24 and the fold line 30.

In the steps of convolute wrapping and sealing the leading edge 34 over the trailing edge 56, adhesive is preferably not applied to the pull tab 32 such that the tab 32 extends freely and essentially tangentially from the leading edge 34 of the skirt 16. This facilitates easy grasping of the pull tab 32 by a user to tear off the tamper evident portion 22 along the score line 24. Additionally, the aforementioned configuration encourages outward pulling of the tab 32 to increase the probability of a clean break along the score line 24 and avoid erratic tearing along the skirt 16 upwards or downwards from the score line 24.

The interference members 38 may be formed by pulling on the inner band 28 at spaced intervals, which may have a consistent value around the inner band 28 if desired (e.g., every 30 degrees, 60 degrees, 90 degrees, etc.). Preferably, the pulling forms a pair of creases 62 running diagonally along the inner band 28 from the upper free edge 40 thereof to the fold line 30 to establish the shape of the interference members 38 with an impact edge 64, as seen in FIGS. 2 and 4. Because of the cross-sectional shape of the interference members 38, and likewise the profile of the upper free edge 40 of the inner band 28, the members 38 are afforded a degree of lateral stability to resist buckling or collapsing when an attempt is made to pull the container lid 10 away from the base container 100 and impact the edge 64 with the container top rim 102. Additionally, the creases 62 bias the impact edge 64 inwardly away from the opposing relation with the outer band 26 (and away from the remainder of the inner band 28) towards the base container 100 when mounted thereon. This ensures that a good interference is maintained between the interference members 38 and the top rim 102 of the base container 100.

The container lid 10 may thus be manufactured with a tamper evident feature already in place, merely requiring that the lid 10 be applied or mounted onto the base container 100 for full activation. One suitable application method for the container lid 10 is by wipe on in the same fashion as standard food container lids are applied (e.g., cylindrical ice cream container lids). The interference members 38 are oriented such that the inner band 28 can easily slide past the container top rim 102 as the container lid 10 is pushed onto the base container 100 from above. Once the inner band upper free edge 40 passes by the container top rim 102 during container lid 10 application, the interference members 38 snap inward towards the base container sidewall 104 to form the interference with the top rim 102. This provides the advantage of requiring no other post activation by the user once the desired product is placed in the base container 100 and the container lid 10 is "wiped on".

From the forgoing, it can be seen that the container lid 10 of the present invention provides an effective device for alerting consumers of attempts to remove the covering from a base container, while also serving to thwart such attempts. The tamper evident portion 22 is also easy to remove by the purchasing consumer so that once the tamper evident nature of the lid 10 have served their purpose, the consumer is not significantly impeded in accessing the product in the base container 100. Furthermore, since certain changes may be made in the above invention without departing from the scope hereof, it is intended that all matter contained in the above description or shown in the accompanying drawing be interpreted as illustrative and not in a limiting sense.

What is claimed is:

1. A process for manufacturing a tamper evident container lid for use in covering a base container having a top rim, comprising the steps of:

forming a paper sheet with a leading edge, a trailing edge, a top edge and a bottom edge, with a longitudinal score line extending generally from at least proximal the leading edge to at least proximal the trailing edge and a longitudinal fold line spaced from the score line extending generally from at least proximal the leading edge to at least proximal the trailing edge;

convolute wrapping the sheet such that the leading edge is wrapped over the trailing edge and sealing a region of the sheet proximal to the leading edge over a region of the sheet proximal to the trailing edge to form the sheet into a skirt;

attaching a lid body with the skirt to form a container lid; and folding a portion of the skirt below the longitudinal fold line inwardly and upwardly towards the lid body to form the skirt into an inner band positioned in generally opposing relation to an outer band defined between the longitudinal score line and the longitudinal fold line;

wherein a plurality of sections of the inner band are adapted such that upon application of the container lid to the base container whereby the inner band is slid downwardly past the base container top rim, the inner band plurality of sections impede removal of the container lid from the base container by engaging with the top rim;

wherein the plurality of sections are formed as interference members by pulling on the inner band at spaced intervals inwardly away from the outer band.

2. The process of claim 1, wherein the longitudinal fold line is formed parallel to the longitudinal score line.

3. The process of claim 1, wherein the paper grain direction of the sheet is generally parallel to the path of the longitudinal score line.

4. The process of claim 1, wherein a pull tab is formed between the longitudinal score line and the longitudinal fold line proximal to the leading edge.

5. The process of claim 1, wherein each interference member includes a pair of creases to bias the interference member inwardly away from the outer band.

* * * * *